United States Patent [19]

Nguyen Duc

[11] 4,207,639

[45] Jun. 17, 1980

[54] FLOATING TERMINAL FOR LOADING AND/OR UNLOADING TANKERS

[75] Inventor: Xuong Nguyen Duc, Rueil Malmaison, France

[73] Assignee: Institut Francais du Petrole, Rueil-Malmaison, France

[21] Appl. No.: 886,423

[22] Filed: Mar. 14, 1978

[30] Foreign Application Priority Data

Mar. 25, 1977 [FR] France ..... 77 09254

[51] Int. Cl.[2] ..... B63B 21/52; B63B 51/02

[52] U.S. Cl. ..... 9/8 P; 114/230; 141/387

[58] Field of Search ..... 9/8 P; 114/230; 191/12 R; 137/355.16, 355.2, 355.25; 141/387, 388, 279, 28

[56] References Cited

U.S. PATENT DOCUMENTS

| | | | |
|---|---|---|---|
| 2,439,010 | 4/1948 | Lange | 191/12 R |
| 2,984,714 | 5/1961 | Kunkle | 191/12 R |
| 3,465,374 | 9/1969 | Johnson | 9/8 P |
| 3,674,062 | 7/1972 | Ellers | 141/387 |
| 3,894,567 | 7/1975 | Mott | 141/388 |
| 3,913,157 | 10/1975 | Versluis | 9/8 P |

*Primary Examiner*—Trygve M. Blix
*Assistant Examiner*—D. W. Keen
*Attorney, Agent, or Firm*—Craig & Antonelli

[57] ABSTRACT

This terminal comprises an upright buoyant structure connected to the water bottom through a flexible supply pipe. A flexible delivery pipe connected to the supply pipe is supported by a buoy on the water surface, this delivery pipe passing on return pulleys carried by the structure. At least one of these pulleys is moveable along the structure and associated with pull back apparatus for urging the delivery pipe towards a storage position on the buoyant structure.

6 Claims, 10 Drawing Figures

FLOATING TERMINAL FOR LOADING AND/OR UNLOADING TANKERS

The present invention relates to floating terminals for loading and unloading tankers at sea.

More particularly, this invention relates to floating unloading terminals comprising a buoyant structure anchored by suitable means and connected through a flexible, rigid or articulated flow line to a fluid source which may be located underwater, and a flexible delivery pipe for transfering the fluid from the flexible pipe to the tanker.

The delivery pipe is generally of a substantial length, about one hundred meters or more. Thus arises the problem of storing this pipe when the terminal is not in service.

When the buoyant structure is of very small size, so as to reduce the action of external forces on the terminal, it is practically impossible to equip this buoyant structure with a motor-driven drum for storing the delivery pipe as may be done with buoyant structures of a very large size including frequently incorporated fluid storage tanks. There is thus often used delivery pipes whereof at least the portion adjacent to their free end is floating on the water surface.

In addition to the trouble caused to navigation by this floating delivery pipe when not in service, a rapid wear of this pipe will result from the action of swell.

This drawback is met with the present invention which provides a floating terminal wherein the delivery pipe can be automatically put into a preselected storage position and kept under tension, when not in service.

Figure 1:
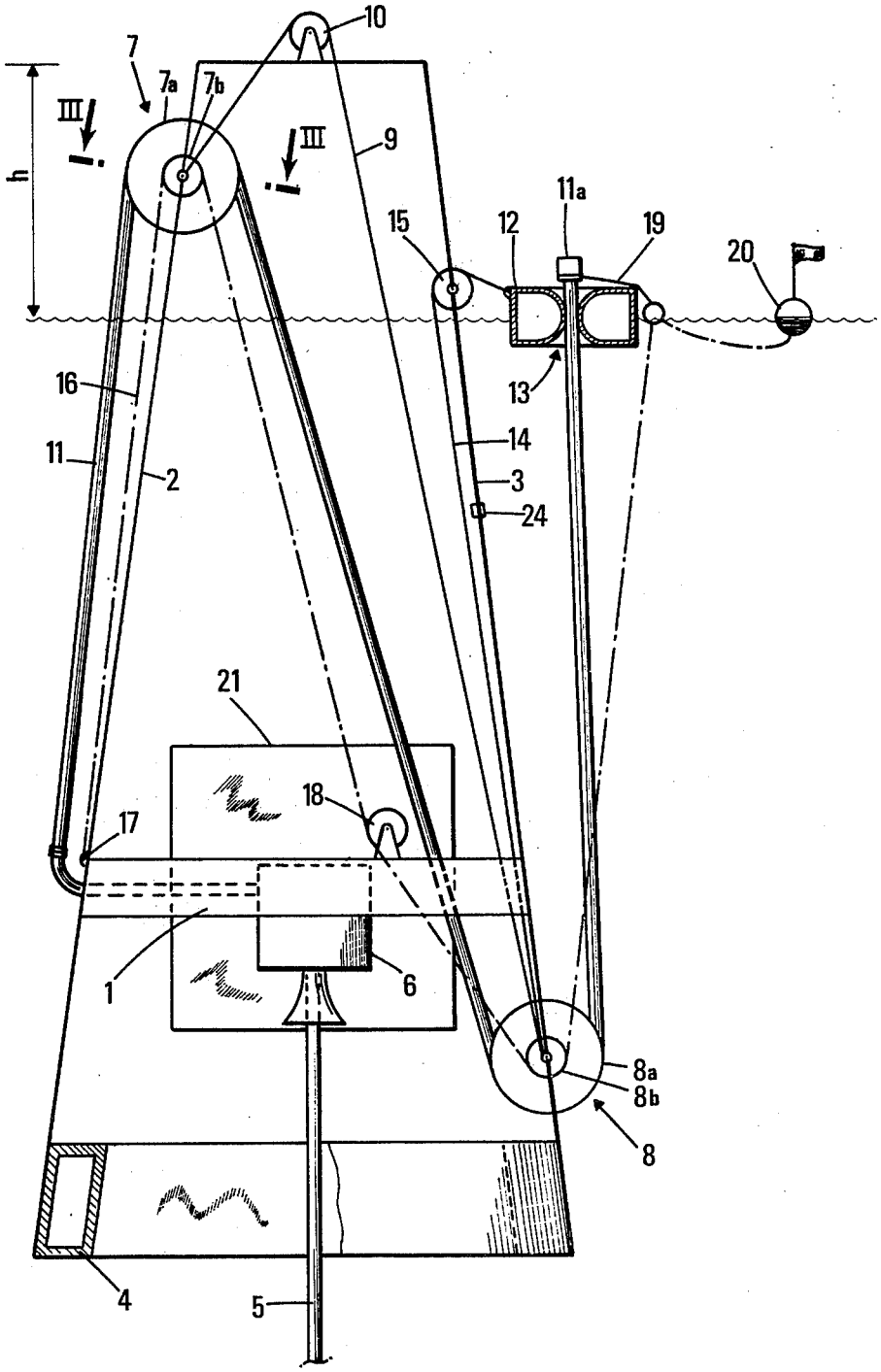
Figure 2A:
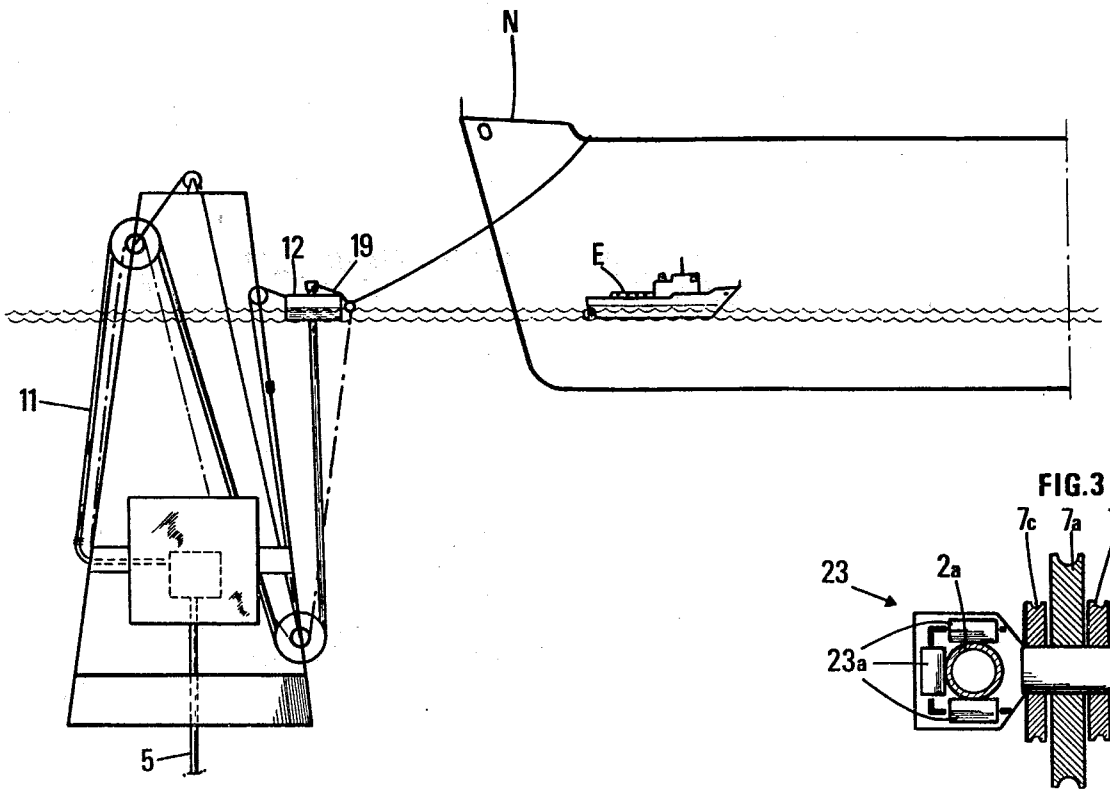
Figure 3:
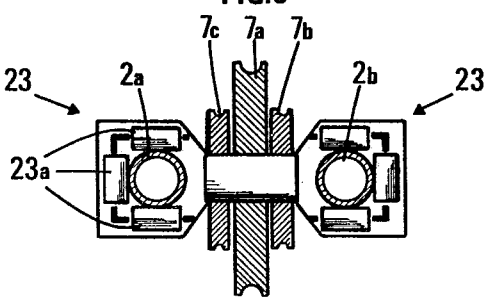
Figure 2B:
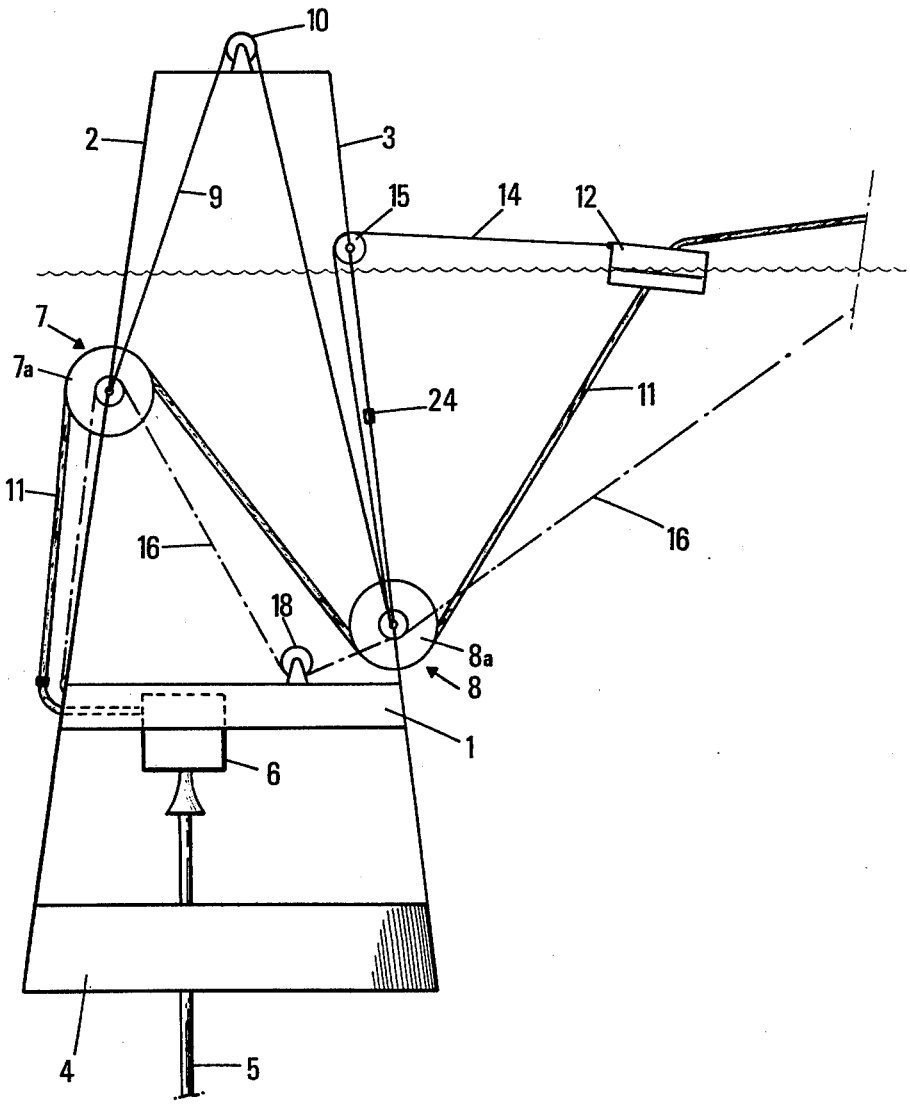
Figure 2C:
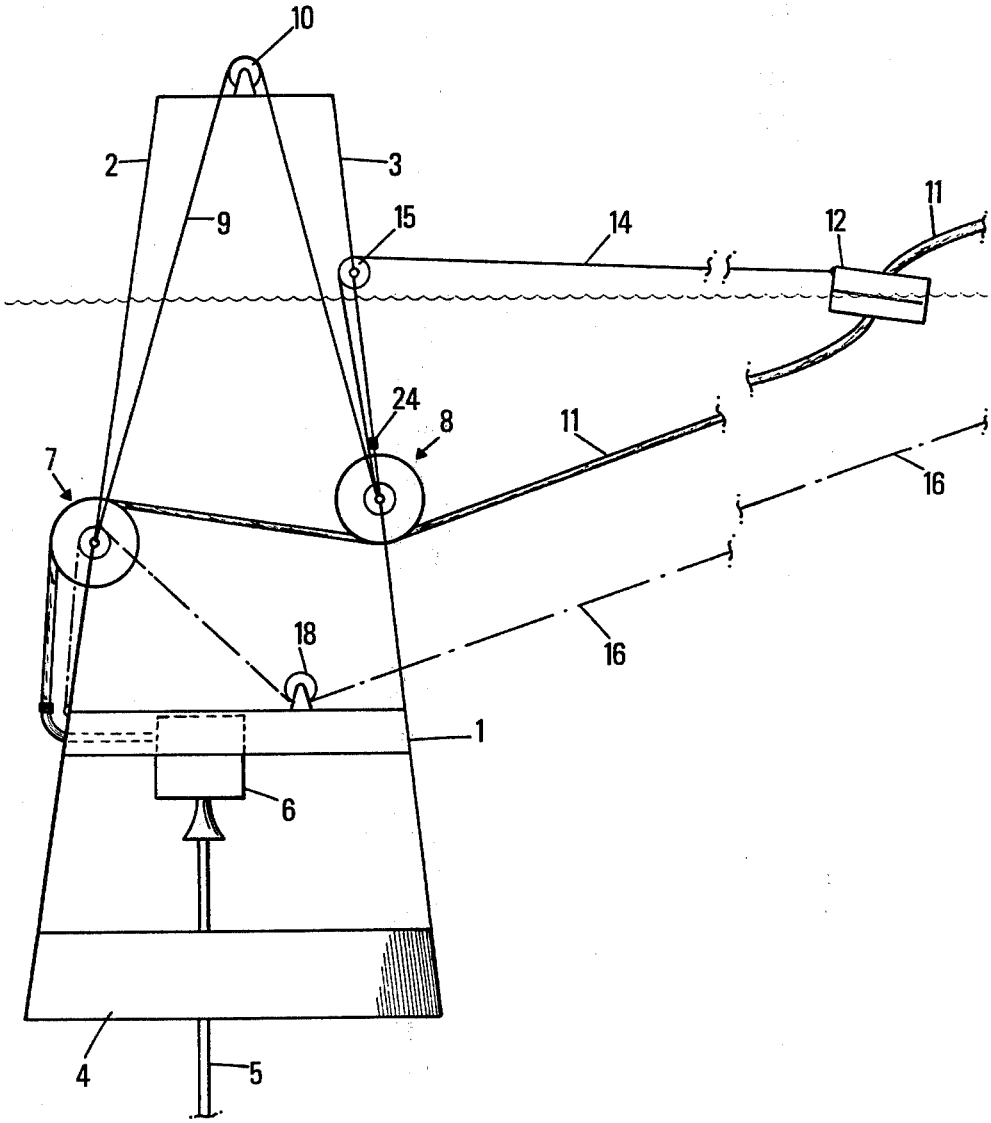
Figure 4:
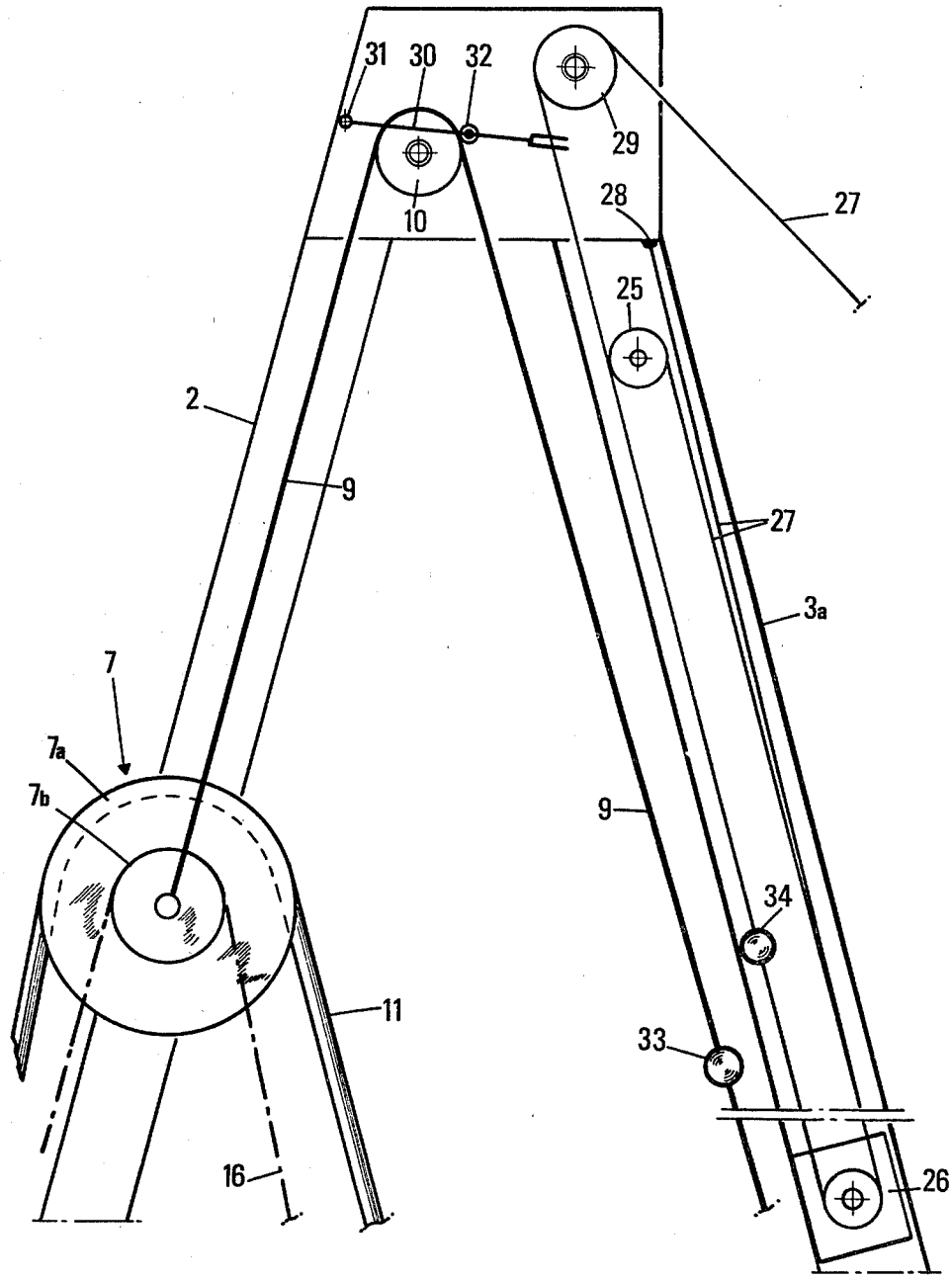

The invention will be readily understood and its advantages become apparent from the following description of non-limitative embodiments illustrated by the following drawings, wherein:

FIG. 1 diagrammatically illustrates a floating terminal according to the invention, FIGS. 2A, 2B and 2C illustrate the different steps of carrying out the invention, FIG. 3 shows a cross section along line III—III of FIG. 1, FIG. 4 shows means for locking the heavy element in its uppermost position, FIGS. 4A to 4D illustrate the operation of these locking means.

FIG. 1 diagrammatically illustrates an embodiment of the invention which comprises a platform 1 carrying an upright structure comprising essentially two arms 2 and 3 of great length, and a stabilizing element 4, which may, for example, be of annular shape, supported under platform 1 at the lower end of arms 2 and 3. Platform 1, arms 2 and 3 and stabilizing element 4 are hollow elements which give to the assembly a positive buoancy. At least some of these elements may be ballasted, such as for example by introducing water into suitable (not illustrated) compartments, to regulate the buoancy of the assembly, so that, at its location of use, the vertical structure rises above the water lever over a height h greater than that of the strongest waves which may be encountered during the periods of use of the terminal.

The above-defined buoyant assembly which forms the loading and/or unloading terminal for a tanker is connected to a source of pressurized fluid through an underwater supply pipe or riser 5 which may be of any known type. This pipe may for example, but not exclusively, be formed of at least two rigid pipe portions hingedly connected to each other, or also of a flexible pipe of a type comprising a watertight tubular member reinforced by armourings capable to withstand pressure, traction and/or torsional stresses.

Anchoring of the buoyant terminal may be secured by (not illustrated) anchoring lines or by pipe 5 itselt if the latter is so designed as to perform this anchoring function. The upper end of pipe 5 is secured to platform 1 through a swivel coupling 6 permitting rotation of the loading terminal about its vertical axis without subjecting pipe 5 to any substantial torsional stress. The loading terminal is provided with two direction reversing elements 7 and 8, respectively displaceable along arms 2 and 3 of the upright structure. Preferably, as shown by FIG. 1, each of these direction reversing elements is formed by coaxial pulleys 7*a*–7*b* and 8*a*–8*b* which may or not have the same outer diameter.

The direction reversing element 8 has an apparent weight in water greater than the weight of direction reversing element 7, and the direction reversing elements 7 and 8 are interconnected by a connecting cable 9 of a determined length, passing on a pulley 10 secured at the top of the upright structure. Thus, in the absence of any external force, the direction reversing elements 7 and 8 are in the position illustrated in FIG. 1, i.e. direction reversing element 7 is close to the top of the guide arm 2 and direction reversing element 8 is close to the lower end of arm 3.

The loading terminal is equipped with a delivery pipe 11 consisting of a flexible pipe having one end in communication with supply pipe 5 through swivel coupling 6.

Delivery pipe 11 passes successively on pulley 7*a*, then on the other pulley 8*a* and its free end 11*a* is supported by a buoyant element 12 which may be provided with a bore 13 for the passage of pipe 11.

The end 11*a* of pipe 11 may obviously be obturated by any suitable (not illustrated) means which needs not to be described here in detail.

Element 12 has a buoyancy greater than the weight of pipe 11 and of direction reversing elements 7 and 8. The buoyant element 12 is connected to the heavier direction reversing element 8 through a pull back cable 14 passing on a reversing pulley 15 secured to the structure. The length of this cable 14 is such that buoyant element 12 be located in the immediate vicinity of the upright structure, when direction reversing element 8 is in its position shown by FIG. 1.

The loading terminal is also provided with a cable 16 shown in dotted line in FIG. 1, which permits mooring of the tanker to the terminal. This mooring cable has one end secured at 17 to platform 1 and passes successively on pulley 7*b*, then on a pulley 18 secured to the platform 1, thereafter on pulley 8*b* and then rises to the water surface where this mooring cable is secured through an auxiliary cable 19 to a buoyant element or marking buoy 20.

When the loading terminal is not in service, the apparent weight of the direction reversing element 8 keeps under tension the delivery pipe 11 and the mooring cable 16, each of them having one end secured to platform 1 and one end suspended from buoyant element 12.

Every time a tanker is used for transfering fluid from the loading terminal according to the invention, the following preliminary steps are successively carried out:

1. The tanker N being kept stationary at some distance from the loading terminal, buoy 20 is picked up by means of a grappling hook, or an auxiliary boat E, and the end of mooring cable 16 is secured to the drum of a (not shown) handling winch carried on ship N (FIG. 2A).

2. This handling winch is operated to reel the mooring cable. This results in tensioning mooring cable 16 and distribution pipe 11 which apply to the direction reversing elements 7 and 8 forces displacing these elements along the guide paths 2 and 3. Simultaneously buoy 12 is displaced on the water surface so that pull back cable 14 remains permanently under tension (FIG. 2B).

The value of the tension in the mooring line is then close to the difference of the respective apparent weights of elements 7 and 8.

3. As reeling of cable 16 proceeds, the latter, owing to its contact with pulley 18, is released from pulley 8*b*. The tension force is then wholly supported by mooring cable 16 which acts on pulley 7*b* so as to further displace direction reversing element 7 and consequently direction reversing element 8, until the latter reaches its uppermost position (FIG. 2C) in which it is automatically locked by suitable locking means described below.

During such periods, tensioning of mooring cable 16 is compensated for by the action of ship N engines, so as to avoid any displacement of this ship towards the loading terminal.

4. The end of pipe 11 can then be connected to tanker N after disconnection of auxiliary cable 19.

5. Tension in the mooring cable 16 is adjusted to the necessary value, taking into account the external forces (wind, heave, sea currents) acting on the ship.

To facilitate the orientation of the loading terminal, vertical orientation plates or fins 21 (FIG. 1) may be provided, these fins being for example secured to platform 1 and located parallelly to the planes of pulleys 7*a* and 8*a*. The dissymmetric arrangement of the loading terminal may in most cases be sufficient to maintain a proper orientation of this loading terminal.

After the steps of transfering fluid from the loading terminal to tanker N, the following operations are carried out:

1. Pipe 11 is disconnected from tanker N and the end 11*a* of pipe 11 is connected to mooring cable 16 through auxiliary cable 19.

2. Direction reversing element 8 is released and the mooring cable unreeled which results in a displacement of elements 7 and 8 and simultaneously a displacement of buoy 12 towards the loading terminal. This operation is continued until the whole device comes back to its position shown in FIG. 1, wherein mooring cable 16 and pipe 11 are kept under tension.

In the illustrated embodiments, pull back cable 14 is shorter than flexible pipe 11 and one of its ends is connected to the moveable direction reversing element 8. It will be obviously possible however to use a pull back cable 14 of substantially the same length as flexible pipe 11, this cable having one end secured to platform 1, for example near the connecting point 17 of mooring cable 16, and also passing on the direction reversing elements 7 and 8 before bearing on pulley 15.

FIG. 3 shows in cross-section along line III—III of FIG. 1, one of the moveable direction reversing elements 7, 8 and the guide means thereof.

This direction reversing element comprises at least one pulley adapted to receive flexible pipe 11, mooring cable 16 and optionally pull back cable 14. In the illustrated embodiment direction reversing element 7 comprises three separate pulleys 7*a*, 7*b* and 7*c* which are freely rotatable about a shaft 22. The so-formed assembly is located between two tubular guide elements 2*a* and 2*b* which constitute the arms of the structure. Shaft 22 is at each of its ends secured to a guide ring diagrammatically illustrated at 23, which co-operates with one of guide tubes 2*a* and 2*b*. Such guide rings may have different designs, using for example elements such as rollers 23*a* to reduce wear along the guide arms.

FIG. 4 diagrammatically illustrates a particular, non-limitative embodiments of the means for locking direction reversing element 8 in its uppermost position, limited by an abutment 24 (FIG. 1).

These locking means comprise, located within one of tubular elements 3*a*, constituting the arm 3 of the structure, a stationary sheave block 25 and a moveable block 26 which are interconnected through a handling cable 27 of sufficient length, having one end secured at 28 on the structure, its other (not shown) end being secured to the end 11*a* of flexible pipe 11 or of buoy 20. This cable also passes on a pulley 29 and between the arms of a yoke member 30 hinged on a stationary point 31. This yoke member 30 carries a roller 32 which may contact cable 9 when the latter passes on pulley 10. Weights 33 and 34 are fixed at a determined location on cables 9 and 27 the utility of these weights being indicated hereinunder in connection with the description of the operation, illustrated by FIGS. 4A to 4D.

Figure 4A:
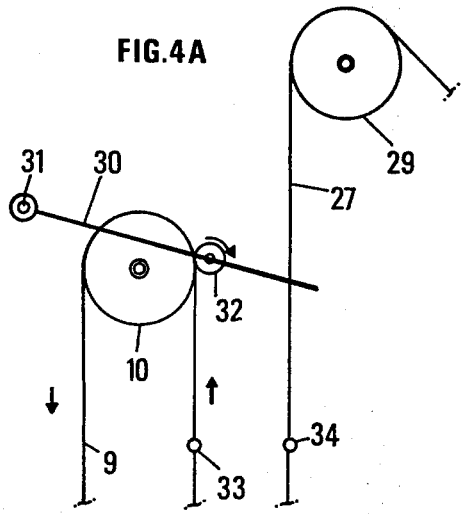

The yoke or articulated lever 30 is in the position shown in FIG. 4A, the roller 32 being in contact with cable 9.

By pulling the flexible pipe 11 as above indicated, the direction reversing pulley 7 moves downwardly. Weight 32 moves upwardly as indicated by the arrow of FIG. 4A.

Figure 4C:
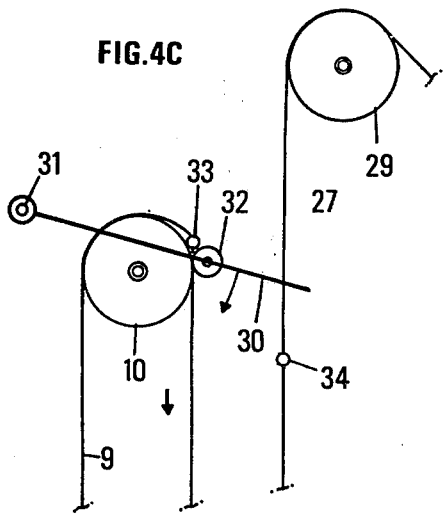
Figure 4B:
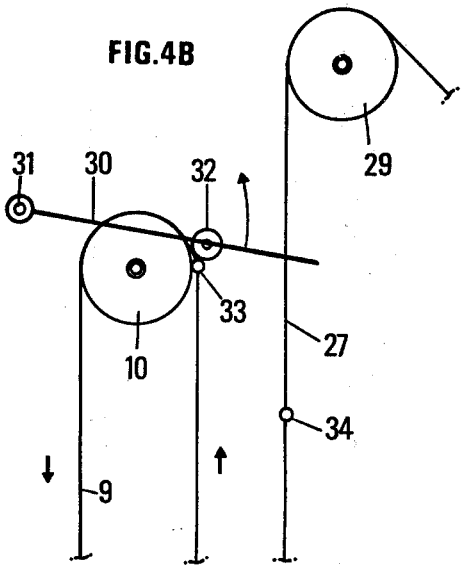

When weight 33 reaches roller 32, it rotates lever 30 about its axis (FIG. 4B). Tipping of lever 30 moves roller 32 away from cable 9, leaving a space which is sufficient to let weight 33 pass therethrough, this weight moving further until the direction reversing element 8 reaches abutment 24. Lever 30 comes back to its initial position under the action of its own weight.

When the traction applied to the flexible pipe 11 decreases, the weight of the direction reversing element 8 tends to drive cable 9 in the direction indicated by the arrows in FIG. 4C and weight 33 is automatically locked in its position by roller 32. Thus the direction reversing element 8 is kept stationary and it becomes possible to release the tension in flexible pipe 11 during the operations of liquid transfer.

Figure 4D:
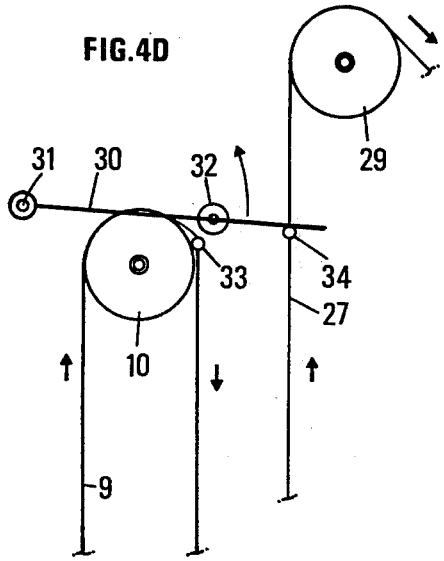

When these transfer operations are over, unlocking can be achieved by pulling cable 27 (FIG. 4D). The weight 34 carried by cable 27 causes tilting of lever 30, thus releasing weight 33. The direction reversing element 8 is again freely displaceable along its guide arm to maintain flexible pipe 11 taut and bring it back to its initial position.

Changes may be made without departing from the scope of the present invention. For example the locking means may be of another type (for example electromagnetic) and remotely controlled or actuatable by an operator having access to the top of the structure.

What we claim is:

1. A loading and/or unloading floating terminal for a tanker, comprising a buoyant structure, means for anchoring this structure, a supply pipe connecting the terminal to a fluid source, a flexible delivery pipe, these pipes communicating with each other through a coupling device carried by the floating terminal, this terminal comprising an element separate from said structure, said element permanently floating on the water surface and supporting the free end of said delivery pipe, and a heavy element suspended from the delivery pipe so that the latter forms between said coupling device and said floating element at least one loop portion when no traction force is exerted on the free end of the delivery pipe, and further comprising a first substantially vertical guide path, said heavy element being slidable along this guide path under the action of the external forces applied to this heavy element, and comprising at least one second guide path and at least one direction reversing means displaceable along said second guide path, said delivery pipe passing on said direction reversing means whose weight remains at any time lower than that of said heavy element, a cable of determined length connecting said heavy element to said direction reversing means and passing on a pulley which is stationary on the floating terminal and located at a higher level than said heavy element and said direction reversing means.

2. A floating terminal according to claim 1 comprising a mooring cable for connecting the tanker to the floating terminal, said mooring cable having one end secured to the floating terminal and passing successively on said direction reversing means, then on a pulley fixed on the floating terminal, so as to form at least one loop portion, the free end of the delivery pipe being connected to said mooring cable.

3. A floating terminal according to claim 2, comprising automatic pull back means for bringing said buoyant element to the immediate vicinity of the terminal out of the periods of service of this terminal.

4. A floating terminal according to claim 3, wherein said pull back means comprise a pull back cable secured at one end to said buoyant element and at its other end to said heavy element and a pulley whereon said pull back cable passes, said pulley being carried by the floating terminal.

5. A floating terminal according to claim 3, wherein said pull back means comprise a return cable secured at one end to said buoyant element and at its other end to the floating terminal and a pulley integral with the floating terminal, said pull back cable having substantially the same length as the delivery pipe and passing on said pulley, on said heavy element and on said direction reversing means.

6. A floating terminal according to claim 3, comprising a device for locking said heavy element in an upper limit position.

* * * * *